United States Patent [19]

Nipple

[11] Patent Number: 4,557,322

[45] Date of Patent: Dec. 10, 1985

[54] HEAT EXCHANGER CLOSURE SYSTEM

[75] Inventor: Stephen B. Nipple, Indianapolis, Ind.

[73] Assignee: Kennedy Tank & Manufacturing Company, Inc., Indianapolis, Ind.

[21] Appl. No.: 629,199

[22] Filed: Jul. 9, 1984

[51] Int. Cl.[4] ..... F28F 9/02

[52] U.S. Cl. ..... 165/158; 165/154

[58] Field of Search ..... 165/158, 154

[56] References Cited

U.S. PATENT DOCUMENTS

| | | | |
|---|---|---|---|
| 2,268,507 | 12/1941 | Gertzon | 165/158 |
| 2,290,528 | 7/1942 | Bertram | 165/158 |
| 2,296,620 | 9/1942 | Tinker | 165/158 |
| 2,520,755 | 8/1950 | Brown | 165/158 |
| 3,018,090 | 3/1962 | Kaase et al. | 257/247 |
| 3,079,992 | 3/1963 | Otten et al. | 5/76 |
| 3,085,820 | 4/1963 | Pollia | 285/368 |
| 3,109,671 | 11/1963 | Braun | 285/133 |
| 3,155,404 | 11/1964 | Brown, Jr. et al. | 285/137 |
| 3,249,153 | 5/1966 | Holland | 165/76 |
| 3,377,087 | 4/1968 | Samerdyke et al. | 285/14 |
| 3,424,480 | 1/1969 | Holland | 285/111 |
| 3,526,275 | 9/1970 | Vance et al. | 165/158 |
| 3,593,782 | 7/1971 | Draves | 165/143 |
| 3,948,315 | 4/1976 | Powell | 165/70 |

FOREIGN PATENT DOCUMENTS

| | | | |
|---|---|---|---|
| 382911 | 5/1971 | U.S.S.R. | 165/158 |

OTHER PUBLICATIONS

Document entitled "Construction Details", Form PE-64, issued 2/76, (believed to have been published by Brown Fintube Co.).

Document entitled "Closure Ass'y for Double Pipe", Bos-Hatten, Inc., dated 3/4/83.

Three documents of Smithco Engineering Co. (undated), entitled "Standard Alcotwin Multiuse Closure Max. Des'g. P.S.I. 600 Shell & Tube", High Pressure Shell and Tube Closure, and Standard Alcotwin Single Tube Closure Max Des'g. P.S.I. 600 Shell & Tube.

Document of Alco Products Inc. (undated), entitled "Thru-Bolt Ass'y".

Document (untitled and undated), illustrating a "Double-Pipe Closure", a Heavy Duty Closure, and a Severe Service Closure.

*Primary Examiner*—Douglas Hart

*Attorney, Agent, or Firm*—Willian Brinks Olds Hofer Gilson & Lione

[57] ABSTRACT

A closure system for heat exchangers, and, in particular for heat exchangers of the hairpin type. The system is designed to have a plurality of annular, substantially flat sealing surfaces against which sealing means of rectangular cross section can be applied to provide effective, reliable seals that will prevent fluid leakage. One of the sealing surfaces is defined by three, substantially coplanar portions; a first portion on the terminal portion attached to the outer shell of the heat exchanger, a third portion formed on the tube sheet that supports a plurality of tubes within the outer shell, and a second intermediate portion defined by an end face of a split retaining ring of L-shaped cross section. Besides providing an effective seal, compression of the sealing means against the first sealing surface also serves to lock the retaining ring in place to prevent relative longitudinal movement between the outer shell and the tube sheet and the tubes supported thereby. A second, independently accessible seal may also be provided by an annular gasket of rectangular cross section. The closure system of the present invention is relatively simple in design in that it avoids the need for tapered or other complex sealing surfaces or unusually shaped sealing rings. It also permits the heat exchanger to be easily disassembled for maintenance or inspection and thereafter reassembled for use.

20 Claims, 5 Drawing Figures

HEAT EXCHANGER CLOSURE SYSTEM

BACKGROUND OF THE INVENTION

The present invention relates generally to a closure system for heat exchangers whereby fluids in first and second fluid passageways are positively sealed against leakage to the atmosphere and against interleakage between the passageways.

The closure system of the present invention is particularly suitable for use in connection with heat exchangers, examples of which are described in U.S. Pat. Nos. 3,018,090; 3,079,992; 3,109,671; 3,155,404; 3,377,087; 3,424,480; 3,593,782 and 3,948,315. Such heat exchangers can comprise an inner tube assembly with a plurality of U-shaped tubes with one end of the U comprising a fluid inlet for the tubes and the other end comprising a fluid outlet. The tubes are supported at each end in spaced relationship with respect to one another by a supporting member which is usually referred to as a tube sheet, and which comprises a generally disk-shaped element having a plurality of apertures through which the ends of the tubes extend.

The U-shaped tubes are supported within an outer shell assembly which is also of generally U-shaped configuration. The base of the shell assembly, however, adjacent the bend in the U-shaped tubes, is provided with a removable cover so that the assembly consisting of the tubes and the tube sheets in which they are mounted can be inserted into and withdrawn from the shell as a unit by sliding the assembly longitudinally through the arms of the shell. Once the tubes are in position within the shell, the cover is secured to the base of the shell in a fluid-tight manner.

A fluid inlet port is formed in the sidewall of the shell adjacent one end thereof, while a fluid outlet port is formed in the sidewall near the opposite end of the shell. A fluid is caused to circulate through the shell and around the plurality of tubes from the inlet port to the outlet port.

A closure member is attached to a terminal portion or member provided on each end of the shell, and each is formed with a conduit to permit another fluid to flow through the tubes from one end thereof to the other end in heat transfer relationship with the fluid circulating through the shell. These closure members, the terminal members of the shell, and the tube sheets mounted within each end of the shell, together with strategically positioned sealing means and appropriately constructed retaining means, comprise a closure system designed to prevent fluid leakage around the periphery of the tube sheets or to the atmosphere, as well as to prevent any longitudinal movement of the tubes relative to the shell.

A suitable closure system must be effective in preventing the fluid flowing into, through, and out of the plurality of tubes from leaking into and mixing with the fluid flowing through the interior of the shell, and vice versa, as well as in preventing either fluid from leaking out of the heat exchanger into the atmosphere. It must also be able to reliably withstand the very substantial pressures at which the fluid is frequently pumped through the plurality of tubes in heat exchangers of this type. In addition, it is important that the closure system be designed such that the heat exchanger can be easily disassembled to permit removal of the tube and tube sheet assembly from the shell or otherwise provide ready access to the interior of the heat exchanger for inspection, cleaning, or repair and, thereafter, quickly reassembled for use. It is also desirable that the closure system be relatively simple mechanically with a minimum number of easily made components so as to provide a structure that is economical to manufacture and long lasting. In this regard, many known closure systems are designed with sealing surfaces of tapered or even more complex configuration. Such surfaces require accurate alignment with respect to one another; and if any one surface becomes damaged and requires machining, it is usually necessary that other sealing surfaces also be machined.

SUMMARY OF THE INVENTION

In accordance with the present invention, a closure system for heat exchangers is provided which is effective in preventing fluid leakage and which is designed to enable the heat exchanger to be easily disassembled for inspection or maintenance and reassembled for use.

According to one aspect of the invention, the closure system includes a first annular sealing surface positioned to prevent leakage between the terminal member attached to the end of the shell and the tube sheet which supports the plurality of tubes within the shell. This first sealing surface comprises three portions: a first portion formed on the terminal member, a third portion formed on the tube sheet, and a second intermediate portion formed on a face of a split retaining ring that is also utilized to lock the inner tube assembly and tube sheet to the outer shell so as to prevent any relative longitudinal movement therebetween. The split retaining ring has a portion extending generally parallel to the central axis of the tubes and forming the sealing face and a depending portion extending transversely of the central axis of the tubes to retain the tube sheet in the terminal member. In a preferable embodiment, the axially extending portion and depending portion form a split retaining ring with an L-shaped cross section.

According to a presently preferred embodiment, the three sealing surface portions are substantially coplanar to define a flat, annular, first sealing surface against which a simple annular sealing means, such as a gasket of rectangular cross section, can be applied to provide an effective and reliable seal.

According to a further aspect of the invention, a second annular sealing means or gasket, which also may be of rectangular cross section, is positioned to be compressed between second and third, flat, annular, sealing surfaces formed on the tube sheet and the closure member, respectively, to prevent any leakage therebetween. By simply tightening a plurality of bolts coupling the terminal member of the shell to the closure member, both sealing means can be simultaneously compressed against the sealing surfaces in an effective manner.

In accordance with one embodiment of the invention, an annular spacer ring provides independent access to the interior of the tubes while permitting the seal to be maintained on the second fluid within the shell. In this further embodiment, the spacer ring is mounted to the bolts; and nuts are provided to tighten the annular spacer ring against the sealing gasket provided for the tubes to ensure an effective seal of the second fluid upon opening the tube fluid system.

The closure system of the present invention is relatively simple in design in that tapered or other complexly shaped sealing rings or sealing surfaces are not required. The sealing surfaces are all generally flat and do not need to be made to exacting tolerances for effective operation of the system. Thus, the closure system of the present invention can be manufactured quite economically.

The closure system of the present invention may be particularly adapted to heat exchangers of the hairpin type and permits easy assembly or disassembly of the heat exchanger. By simply removing the bolts and disconnecting the closure member from the terminal member on each end of the heating exchanger, the sealing gaskets and spacer ring can be easily removed; and the tube and tube sheet assembly can then simply be slid forwardly to release the split ring and thereafter pulled in the opposite direction out of the sleeve.

Yet further features of specific advantages of the invention will become apparent hereinafter in conjunction with the detailed description of the best mode for carrying out the invention.

BEST MODES FOR CARRYING OUT THE INVENTION

Figure 1:
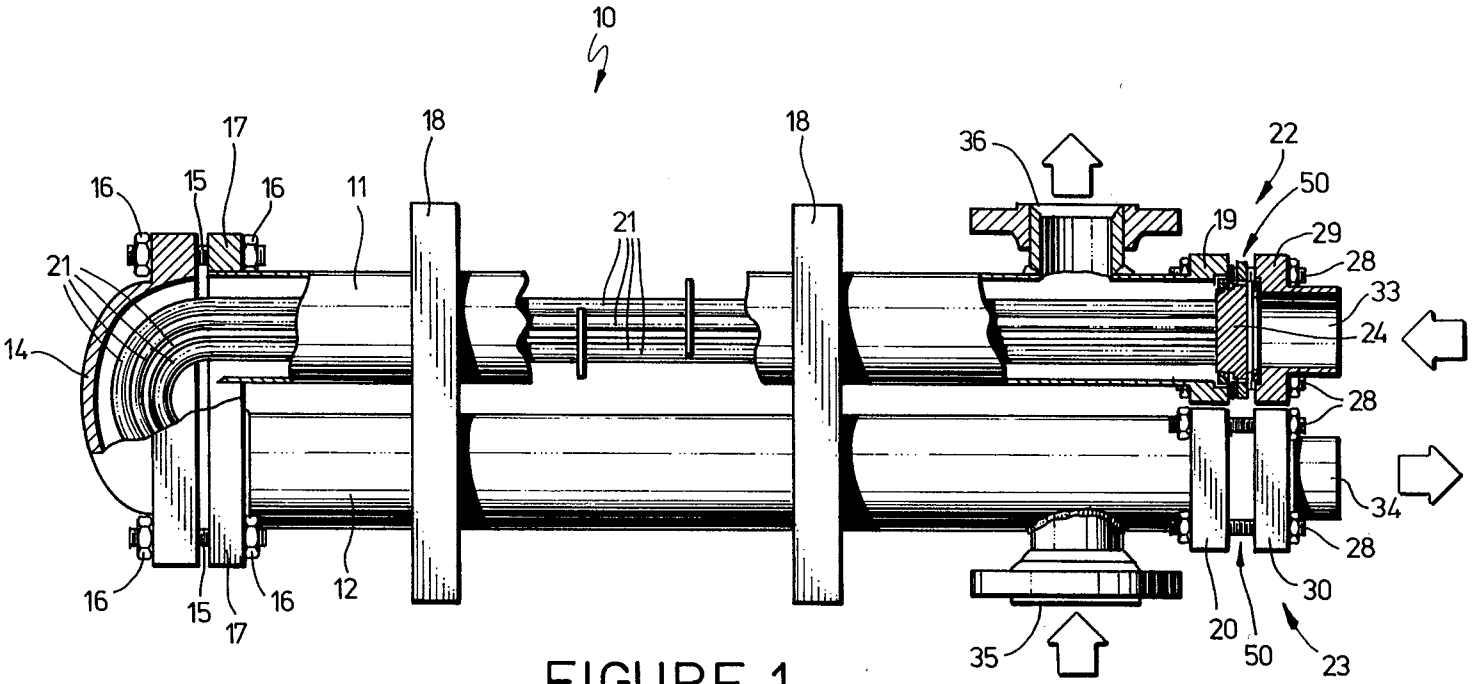
FIG. 1 schematically illustrates, with portions cut away, a heat exchanger, for example, of the hairpin type, in which the closure system of the present invention is employed.

FIG. 1 schematically illustrates a heat exchanger of the hairpin type incorporating the closure system according to one embodiment of the present invention. The heat exchanger, generally designated by reference numeral 10, includes a pair of tubular outer shells 11 and 12 connected together at one end by a flange 17 to define a generally U-shaped outer shell assembly. The outer shell assembly is provided with an opening at its rear end to which a cover 14 is adapted to be removably secured as by bolts 15 cooperating with nuts 16 to clamp the cover 14 to a flange 17 at the U of the outer shell assembly.

The tubular shells 11 and 12 of the outer shell assembly are supported in parallel relationship by a plurality of frame members 18, only two of which are shown, which are spaced along the length of the shells. The forward ends 22 and 23 of the shells 11 and 12 are provided with annular terminal portions or members 19 and 20 which may be welded or otherwise attached to the ends of the shells as better illustrated in FIG. 2.

The heat exchanger also includes an inner tube assembly within the outer shell assembly. The inner tube assembly includes a plurality of U-shaped tubes 21 that are adapted to be positioned within the shells 11 and 12 and the cover 14. Specifically, each tube 21 is of generally U-shaped form, having two straight sections joined together by a curved base section. The tubes may be of one-piece construction or formed in sections as shown.

The forward ends of each of the tubes 21 is secured within disk-shaped tube sheets 24 so that the tubes will be properly spaced relative to the shells 11 and 12 and relative to each other. The tube sheets also facilitate the installation of the tubes in the shells and, in this regard, are sized to have a diameter slightly less than the interior diameters of the shells so that the inner tube assembly can easily be inserted into and removed from the shells as will be explained hereinafter. Each tube sheet has a plurality of spaced apertures through which the ends of the tubes 21 extend and are supported as is illustrated more clearly in FIG. 2.

Preferably, the ends of the tubes are sealed within the apertures in the tube sheets to prevent any fluid leakage from the tubes. This deal can be accomplished in any number of ways that are known in the art, such as by welding the tubes 21 to the tube sheets 24.

The tube sheets 24 with the tubes secured thereto are adapted to be locked in position within the outer shell assembly by split retaining rings which are incorporated within the closure system of the present invention and which will be discussed more fully hereinafter.

Mounted to the outer ends 22 and 23 of the shells 11 and 12 are a pair of closure members 29 and 30. These closure members are adapted to be attached to the terminal members 19 and 20 of the shells by a plurality of bolts 28 which extend through apertures in the terminal members and the closure members. This again is illustrated more clearly in FIG. 2. The closure member 20 is secured to a fluid inlet conduit 33 while the closure member 30 is secured to a fluid outlet conduit 34.

In operation, the heat exchanger transfers heat between first and second fluids that flow respectively within the inner tube assembly and within the outer shell assembly that surrounds the inner tube assembly. The first fluid enters the heat exchanger 10 through inlet conduit 33 and flows through the closure member 29 and into the plurality of tubes 21. The fluid flows through the tubes around their U-shaped base, and ultimately leaves the tubes through outlet conduit 34.

The outer shell 12 is formed with an inlet port 35 adapted to be coupled to a fluid supply while shell 11 is provided with an outlet port 36. The second fluid enters into the heat exchanger through inlet port 35, enters into the passageway formed within the interior of shell 12 and surrounds the tubes therein, circulates into cover 14, and enters shell 11 until it finally exits through outlet port 36. In this way, the two fluids, flowing in opposite directions through the heat exchanger, are maintained in effective heat exchange relationship with respect to one another.

The closure system of the present invention is provided in order to prevent any inter-leakage between the first and second fluids, and to prevent either fluid from leaking from the heat exchanger system adjacent the ends 22 and 23 of the heat exchanger where the inner tube assembly and the outer shell assembly are interconnected. This closure system is generally designated by reference numeral 50 and is illustrated in greater detail in FIGS. 2 and 3.

Figure 2:
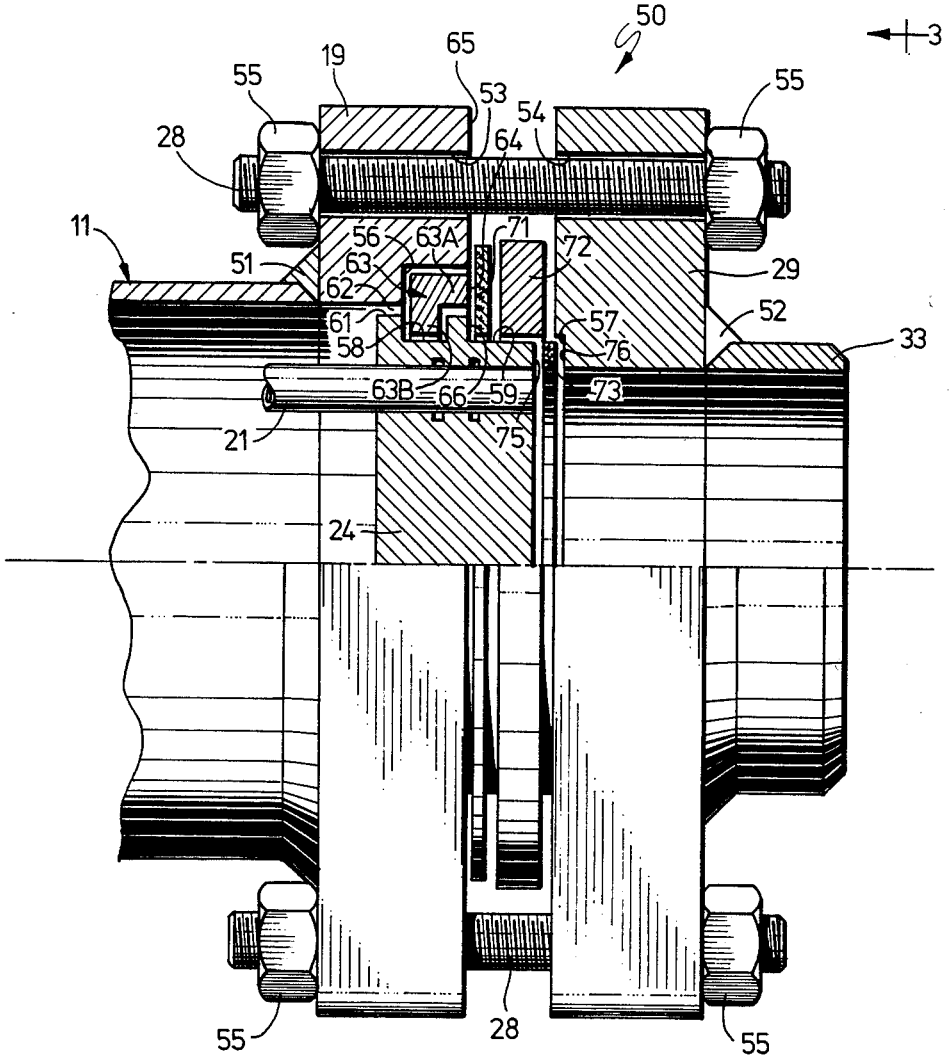
FIG. 2 illustrates a partial cross-sectional view of the closure system according to a presently preferred embodiment of the invention.

More particularly, FIG. 2 illustrates, in a partial cross-sectional view, the closure system incorporated into each of ends 22 and 23 of the shells. Since the closures on ends 22 and 23 are identical, only the closure on end 22 is shown in FIG. 2 and described herein. Initially, terminal member 19 and closure member 29 comprise annular, generally square-shaped elements welded or otherwise attached to the ends of shell 11 and inlet conduit 33, respectively, as illustrated by welds 51 and 52, respectively.

Figure 3:
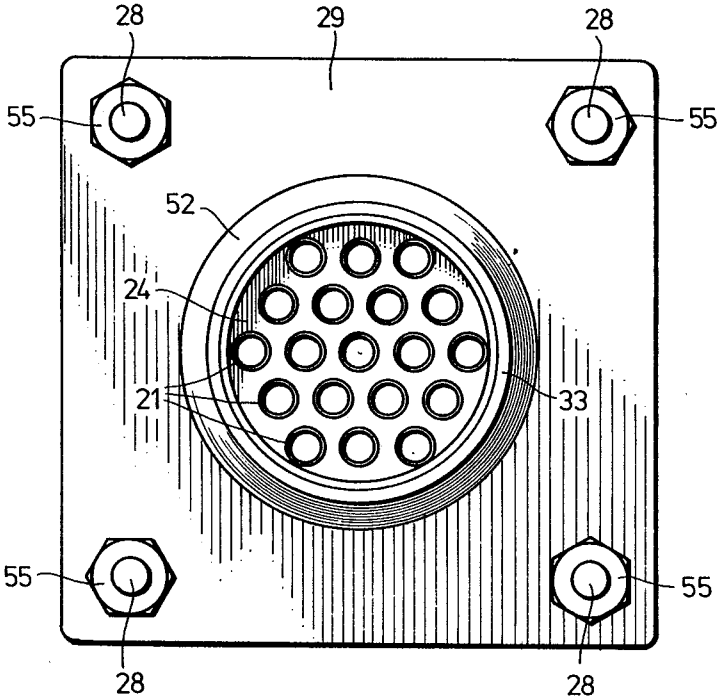
FIG. 3 is a view of the closure system of FIG. 2 looking in the direction of arrows 3—3 in FIG. 2.

Members 19 and 20 are each provided with four aligned apertures 53 and 54, respectively, extending through the corners of the members; and a bolt 28 is extended through each of the apertures as shown in FIG. 2 and FIG. 3, which is a view of FIG. 2 looking in the direction of arrow 3—3 in FIG. 2. Nuts 55 are screwed onto the ends of the bolts and thus attach the closure member 29 to the terminal member 19.

In systems exposed to very high pressures, these members may be of a different design and connected together with a greater number of fasteners. Terminal member 19 is formed to have an annular recess 56 of generally rectangular cross section in the inside portion of its outer face 65, while closure member 29 is provided with a somewhat smaller annular recess 57, also of rectangular cross station in the inside portion of its end face.

The tube sheet 24 is adapted to be positioned within shell 11 as shown in FIG. 2 and is provided with an annular groove 58 and an annular recess 59 formed in its outer peripheral surface 61. Groove 58 is generally centrally positioned in surface 61 to be aligned with recess 56 on terminal member 19, while recess 59 is formed at the outer corner thereof. As also shown in FIG. 2, tube sheet 24 is sized to fit within shell 11 with a slight clearance 62 so that the tube sheet and the tubes 21 secured thereto can easily be slid into and out of the shell.

A split retaining ring 63 is adapted to be positioned within the recess 56 of terminal member 19 and the groove 58 of tube sheet 24 as shown. The split retaining ring 63 has an axially extending portion 63*a* and a depending portion 63*b*. In the preferable embodiment shown, the split retaining ring has a uniform, L-shaped cross section with the depending portion 63*b* extending into the annular groove 58; however, the depending portion 63*b* may in some designs engage a groove or indentation formed in only a portion of the periphery of the tube sheet 24 to retain it within the terminal member. Retaining ring 63 is sized so that end face 64 of its axially extending portion 63*a* will be substantially flush with end face 65 of the terminal member. Similarly, recess 59 on the tube sheet defines a face 66 which is also substantially flush with face 65 of the terminal portion and the face 64 of the retaining ring. Faces 64 and 66 and a portion of face 65 together define an annular, radially extending first sealing surface against which an annular sealing gasket 71 may be pressed to provide a sealing engagement with retaining ring 63 seated in groove 58 and in recess 56.

Sealing means 71 is generally rectangular in cross section and can be formed of any one of a variety of compressible gasket materials that are known and used in the art. An annular compression ring 72 is preferably also provided and is positioned adjacent the sealing means for use in pressing the sealing means against the first sealing surface.

A second annular sealing means 73 is positioned within recess 57 in closure member 29, and is adapted to be pressed into sealing engagement with second and third sealing surfaces 75 and 76 on the tube sheet and the closure member, respectively. The second sealing means 73 can also be formed from the same compressible gasket material as sealing means 71.

With the various components positioned as illustrated in FIG. 2, it is only necessary to rotate the nuts 55 to tighten the bolts 28 until sealing means 71 and 73 are compressed against the first, second, and third sealing surfaces respectively. Sealing means 71 applied against the first sealing surface will provide an effective and reliable seal to prevent second fluid leakage around the outer periphery of the tube sheet between the tube sheet and the terminal member, while sealing means 73 compressed against second and third sealing surfaces 75 and 76 will prevent any first fluid leakage between the closure member and the tube sheet.

Compression ring 72 is sized to ensure that sufficient pressure will be substantially simultaneously applied against both sealing means 71 and 73 upon tightening of the bolts 28 to ensure tight, effective seals. Upon tightening the bolts, the L-shaped split retaining ring 63 will also be locked into position to positively prevent any relative, longitudinal movement between the tube sheet 24 and the tubes 21 supported thereon and the outer shell 11 of the heat exchanger. The same closure system is preferably used at end 23 of the heat exchanger to simultaneously fasten and seal the inner tube assembly to the outer shell assembly.

The closure assembly as described and illustrated in FIGS. 2 and 3, besides providing effective fluid-tight sealing, is mechanically quite simple in that only generally standard-shaped gasketing elements operating against flat sealing surfaces are needed. Complex tapered or shaped sealing surfaces and components are not required, and this reduces the cost of construction and repair of the system.

The closure assembly of the present invention is also designed so that it is quite easy to assemble and later disassemble the heat exchanger to permit access to the interiors of the shells and tubes for cleaning, maintenance, or inspection purposes. Specifically, to disassemble the heat exchanger, it is only necessary to remove the outermost nuts from each of the bolts 28. This permits the closure members 29 and 30 to be removed from the heat exchanger, which, in turn, releases the sealing means 71 and 73 and the spacer ring 72. This permits inspection and cleaning of the interior of the tubes 21 and replacement of the seals 71 and 73. Removal of the inner tube assembly is also easily effected with the system of this invention upon removal of the cover 14. The split retaining ring 63 is removed by movement of inner tube assembly (the tube sheet 24 and the tubes 21 attached thereto) slightly to the right, as illustrated in FIG. 2, to free the split retaining ring 63. With this retaining ring removed, the inner tube assembly can be slid out of the outer shells 11 and 12 as a unit.

Figure 4:
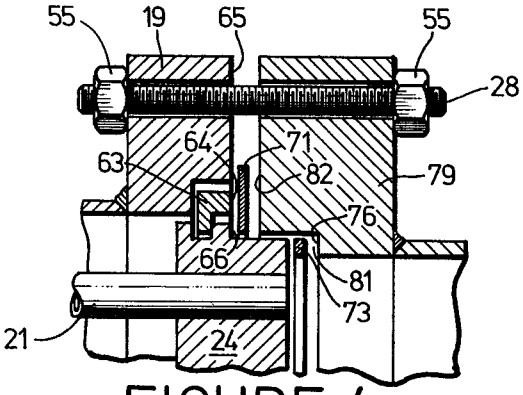
FIGS. 4 and 5 illustrate cross-sectional views of alternative embodiments of the present invention.
Figure 5:
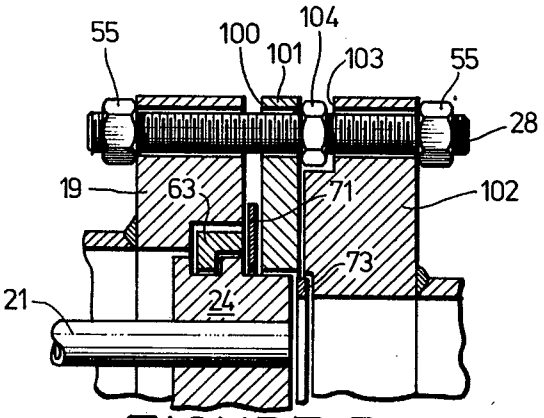

FIGS. 4 and 5 illustrate alternative embodiments of the invention. FIG. 4 differs from the embodiment of FIGS. 2 and 3 in that the spacer ring 72 has been eliminated from the design. Instead, the recess 57 formed in closure member 29 of FIG. 4 has been enlarged somewhat in length as illustrated at 81 so tht the end face 82 of the closure member 79 will itself push against the sealing means 71 to compress it against the first sealing surface defined by the surface portions 64, 65 and 66 as sealing surface 76 compresses sealing means 73.

FIG. 5 illustrates an embodiment which differs from the previous embodiments in that it provides independent access to the interiors of tubes 21. In this embodiment, an annular compression ring 101 is provided with a plurality of apertures 100 for mounting the ring 101 on to each of the bolts 28. Closure member 102 is provided with a further recessed portion 103 so that another sealing nut 104 can also be mounted to each bolt with sufficient clearance to permit closure member 102 to compress sealing means 73 as nut 55 is tightened. Specifically, by tightening nut 104, the spacer ring 101 can be moved to the left to compress sealing means 71 and to provide a seal between the inner tube assembly and the shell that is separate and independent of the seal between the inner tubes 21 and the atmosphere. Thus, in the embodiment of FIG. 5, removal of the nuts 55 will permit access to the interiors of tubes 21 for inspection and cleaning while maintaining seal 71 and retaining the second fluid in the system. Both sealing means 71 and 73 will be compressed into sealing engagement with the various sealing surfaces but by independent use of nuts 104 and 55.

Although what has been described constitute presently preferred embodiments of the invention, it should be understood that the invention could take a variety of other forms. For example, although the invention has been described primarily in connection with a heat exchanger of the hairpin type, it may also have application in connection with other types of heat exchangers or other systems in which fluids must be circulated. Accordingly, it should be understood that the invention should be limited only by the scope of the following claims.

I claim:

1. A heat exchanger comprising an outer shell, said outer shall having a terminal member at one end thereof;

at least one tube positioned within said shell;

means for supporting said at least one tube within said shell adjacent said terminal member;

a retaining ring means for securing said support means and said at least one tube supported thereby against longitudinal movement relative to said terminal member; and means for preventing fluid leakage between said support means and said terminal member; said leakage-preventing means including a first annular sealing surface, said first annular sealing surface comprising a first annular sealing surface portion on said terminal member, a second annular sealing surface portion on said retaining ring means, and a third annular sealing surface portion on said support means; and first annular sealing means positioned in sealing contact with each of said first, second, and third annular sealing surface portions of said first annular sealing surface.

2. A heat exchanger as recited in claim 1 wherein said first, second, and third annular sealing surface portions are substantially coplanar.

3. A heat exchanger as recited in claim 2 wherein said first annular sealing surface extends substantially radially relative to said outer shell.

4. A heat exchanger as recited in claim 2 wherein said second annular sealing surface portion comprises a surface of substantial radial extent positioned betweeen said first and third annular sealing surface portions.

5. A heat exchanger as recited in claim 2 and further including means for pressing said first annular sealing means into sealing contact with each of said first, second, and third annular sealing surface portions of said first annular sealing surface.

6. A heat exchanger as recited in claim 5 and further including a closure member for positioning a fluid conduit in fluid transfer relationship with said at least one tube, and means for attaching said closure member to said terminal member, and wherein said first annular sealing means is positioned between said first annular sealing surface and said closure member and wherein said means for attaching said closure member to said terminal member includes said means for pressing said first annular sealing means into sealing contact with each of said first, second, and third annular sealing surface portions of said first annular sealing surface.

7. A heat exchanger as recited in claim 6 wherein said attaching means comprises a plurality of bolts for attaching said closure member to said terminal member, and further including an annular spacer ring positioned between said closure member and said first annular sealing means for pressing said first annular sealing means into sealing contact with said first, second, and third annular sealing surface portions of said first annular sealing surface upon tightening of said plurality of bolts.

8. A heat exchanger as recited in claim 7 wherein said annular spacer ring is mounted to said plurality of bolts, and further including means for adjusting the position of said spacer ring relative to said plurality of bolts.

9. A heat exchanger as recited in claim 1 wherein said retaining ring means comprises a ring of substantially L-shaped cross section, and wherein the end face of one leg of said L-shaped retaining ring comprises said second annular sealing surface portion.

10. A heat exchanger as recited in claim 9 wherein said support means comprises tube sheet means which includes an annular groove formed in the peripheral face thereof, and wherein said terminal member includes an annular recess formed therein adjacent said annular groove in said tube sheet means, said L-shaped retaining ring being positioned within said groove and said recess for preventing longitudinal movement of said tube sheet means relative to said terminal member.

11. A heat exchanger comprising an outer shell, said outer shell having a terminal member at one end thereof;

at least one tube positioned within said shell;

means for supporting said at least one tube within said shell adjacent said terminal member;

a closure member for positioning a fluid conduit in fluid transfer relationship with said at least one tube;

a retaining ring means for securing said support means and said at least one tube supported thereby against longitudinal movement relative to said terminal member; and means for preventing fluid leakage between said support means and said terminal member; said leakage-preventing means including a first annular sealing surface, said first annular sealing surface comprising a first annular sealing surface portion on said terminal member, a second annular sealing surface portion on said retaining ring means, and a third annular sealing surface portion on said support means, said first, second, and third annular sealing surface portions being substantially coplanar;

first annular sealing means positioned between said first annular sealing surface and said closure member in sealing engagement with said first, second, and third annular sealing surface portions of said first annular sealing surface;

a second sealing surface on said support means and a third sealing surface on said closure member, and second sealing means positioned between said second and third sealing surfaces in sealing engagement therewith for preventing fluid leakage between said support means and said closure member; and means for attaching said closure member to said terminal member, said means for attaching said closure member to said terminal member including means for pressing said first annular sealing means into sealing engagement against said first annular sealing surface.

12. A heat exchanger as recited in claim 11 wherein said attaching means also presses said second sealing means into sealing engagement with said second and third sealing surfaces.

13. A heat exchanger as recited in claim 12 wherein said first and second sealing means comprise sealing gaskets of substantially rectangular cross section.

14. A heat exchanger comprising a tubular-shaped outer shell, said outer shell having a terminal member attached to an end thereof;

an inner tube positioned within said outer shell;

tube sheet means for supporting said inner tube within said outer shell, said tube sheet means being sized to provide a clearance between the outer peripheral surface of said tube sheet means and the inner surface of said terminal member to enable said tube sheet means to be moved longitudinally relative to said terminal member and to said outer shell; and split retaining ring means having a substantially L-shaped cross section adapted to be positioned between said tube sheet means and said terminal member and to releasably secure said tube sheet means to said terminal member to prevent relative longitudinal movement therebetween, wherein said tube sheet means includes an annular groove in the outer peripheral surface thereof and wherein said terminal member includes an annular recess in the inner surface thereof adjacent said annular groove, said L-shaped retaining ring means having a depending portion extending into said annular groove and a longitudinally extending portion positioned within said annular recess.

15. A heat exchanger as recited in claim 14 wherein the end face of the longitudinally extending portion of said L-shaped retaining ring means comprises a portion of an annular sealing surface, annular surfaces on said tube sheet means and on said terminal member also comprising portions of said annular sealing surface, and wherein said heat exchanger further includes sealing means positioned in sealing contact with each of said portions of said annular sealing surface.

16. A heat exchanger of the hairpin type comprising a generally U-shaped outer shell with a terminal member at each end thereof;

generally U-shaped tube means extending the length of said shell and positioned within said shell by tube sheet means, said tube sheet means being positioned adjacent said terminal members, said tube means being adapted to carry a first fluid and said shell being adapted to carry a second fluid in heat exchange relationship with said first fluid in said tube means;

split retaining ring means between said tube sheet means and said terminal members for releasably securing said tube sheet means against longitudinal movement relative to said terminal members;

closure members for closing the ends of said shell and tube means and for transferring said first fluid into or out of said tube means;

means for attaching said closure members to said terminal members; and sealing means for providing a fluid-tight seal between said terminal members and said tube sheet means including an annular sealing surface and a first sealing gasket in sealing contact therewith, said annular sealing surface including a first sealing surface portion on said terminal member, a second sealing surface portion on said split retaining ring means and a third sealing surface portion on said tube sheet means, said first, second and third sealing surface portions being substantially coplanar.

17. A heat exchanger as recited in claim 16 wherein said tube sheet means each include an annular groove formed in the peripheral face thereof, said terminal members each include an annular recess formed therein adjacent said annular groove in said tube sheet means and wherein; said split retaining ring means has an L-shaped cross section, said L-shaped retaining ring means being positioned within said groove and said recess for preventing longitudinal movement of said tube sheet means relative to said terminal members.

18. A heat exchanger as recited in claim 16 wherein said heat exchanger further comprises a second sealing gasket positioned in sealing contact with second and third substantially flat sealing surfaces on said tube sheet means and said closure members, respectively.

19. A heat exchanger system,comprising:

an outer shell assembly;

an inner tube assembly; and means for holding the inner tube assembly positioned within the outer shell assembly and for sealing the inner tube assembly to the outer shell assembly;

said holding and sealing means comprising at least one terminal member at one end of the outer shell assembly, at least one tube spacing means at one end of the inner tube assembly adapted to be slidably received within the terminal member of the outer shell assembly and having a groove portion, a split ring seated on the terminal member and having a depending portion extending into the groove portion of the tube spacing means to retain the tube spacing means within the terminal member, said split ring further having a portion extending axially between the tube spacing means and terminal member and providing a sealable face, and a compressible sealing means in sealing contact with the sealable face of the split ring and adjacent sealing faces formed on the terminal member and tube spacing means.

20. The heat exchanger system of claim 19 wherein:

the terminal member has its sealing face lying in a plane transverse to the central axis of the outer shell assembly;

the tube spacing means has its sealing face lying in a plane transverse to the central axis of the inner tube assembly; and wherein the split ring, when seated in the terminal member with its depending portion in the groove portion of the tube spacing means, positions the sealing faces of the terminal member and tube spacing means substantially in the same plane and presents its sealable face substantially in the plane of the sealing faces of the terminal member and tube spacing means; and the compressible sealing means is an annular gasket having a generally rectangular cross section that is compressed against and in contact with the substantially planar sealing surface formed by the sealing faces of the terminal member, tube spacing means and split retaining ring.

* * * * *

UNITED STATES PATENT AND TRADEMARK OFFICE

CERTIFICATE OF CORRECTION

PATENT NO. : 4,557,322

DATED : DECEMBER 10, 1985

INVENTOR(S) : Stephen B. Nipple

It is certified that error appears in the above-identified patent and that said Letters Patent is hereby corrected as shown below:

In col. 3, line 14, delete "of" (first occurrence) and insert --and-- therefor.

In col. 4, line 8, delete "deal" and insert --seal-- therefor; line 22, delete "20" and insert --29-- therefor; and line 64, delete "20" and insert --29-- therefor.

In col. 5, line 11, delete "station" and insert --section-- therefor; and line 50 insert --also-- in the blank space before the word "provided".

In col. 6, line 52, delete "the".

Signed and Sealed this

*Sixth* Day of *May 1986*

[SEAL]

*Attest:*

DONALD J. QUIGG

*Attesting Officer*

*Commissioner of Patents and Trademarks*